United States Patent [19]

Massey et al.

[11] 4,355,452

[45] Oct. 26, 1982

[54] METHOD OF FORMING A MOUNTING FOR A TANK COVER

[75] Inventors: Raymond D. Massey, Cambridge Park; Vincent Di Santo, Marrickville, both of Australia

[73] Assignee: Zip Heaters (Aust.) Pty. Limited, Marrickville, Australia

[21] Appl. No.: 206,223

[22] Filed: Nov. 12, 1980

[30] Foreign Application Priority Data

Nov. 19, 1979 [AU] Australia ..... PE1390

[51] Int. Cl.[3] ..... B23P 11/00

[52] U.S. Cl. ..... 29/437; 29/511; 29/526 R; 29/517; 220/315; 292/251

[58] Field of Search ..... 29/437, 432, 517, 432,1, 29/511, 526 R; 220/315; 292/251, 291; 411/337

[56] References Cited

U.S. PATENT DOCUMENTS

| | | | |
|---|---|---|---|
| 1,479,358 | 1/1924 | Behringer | 292/251 X |
| 1,854,730 | 4/1932 | Bell | 292/251 |
| 1,857,443 | 5/1932 | Draper | 292/251 X |
| 1,927,780 | 9/1933 | Anderson | 292/251 |
| 2,064,342 | 12/1936 | England | 29/437 |
| 2,968,502 | 1/1961 | Tann | 29/437 UX |
| 2,987,811 | 6/1961 | Acres | 292/251 X |
| 3,060,562 | 10/1962 | Fransson | 29/437 |
| 3,300,850 | 1/1967 | Steuernagel | 29/432.1 |

*Primary Examiner*—Charlie T. Moon

*Attorney, Agent, or Firm*—Ladas & Parry

[57] ABSTRACT

A method of forming mounting for an inspection cover or similar in a sheet metal tank wherein threaded fasteners such as machine screws are inserted in holes burst in the sheet metal around the edges of the opening in the tank wall. The burst metal portions are then pressed into the thread of the screws to hold the screws in place as studs for the mounting of the cover. A reinforcing flange is simultaneously pressed into the sheet metal around the periphery of the opening.

5 Claims, 2 Drawing Figures

METHOD OF FORMING A MOUNTING FOR A TANK COVER

This invention relates to a tank opening and has been devised particularly though not solely as access to a sheet metal tank interior.

In the past sheet metal tanks such as those used for heating hot water have conventionally been provided with access in the top of the tank. The tanks are made from sheet metal folded and welded or soldered as required and the access is conventionally a rectangular hole in the top of the tank. In order to provide a sealable cover it has been necessary to reinforce the edges of the aperture over which the cover is placed to provide a firm mounting for the cover. In the past this has been achieved by soldering or brazing flat bar to the exterior surface of the sheet metal top around the periphery of the hold and soldering or brazing screws or studs through the metal bar at predetermined intervals to provide upwardly protruding studs which engage with holes in the cover so that the cover may be screwed downwardly onto the metal bar by way of fastening nuts. The system has the disadvantage that the reinforcing around the periphery of the aperture is time consuming to manufacture and requires the use of extra metal bar components. These factors add to the cost of the finished product.

It is therefore an object of the present invention to provide a method of forming a mounting for an inspection cover or the like in a sheet metal tank which will obviate or minimise the foregoing disadvantages in a simple yet effective manner or which will at least provide the public with a useful choice.

Accordingly the invention consists in a method of forming a mounting for an inspection cover or the like in a sheet metal tank, said method comprising the steps of forming the desired opening in the sheet metal wall of said tank, bursting a plurality of holes through said sheet metal around the periphery of said opening, inserting headed, threaded fasteners into said holes so that the headed portions thereof lie on the opposite side of said sheet metal from the burst portions of said holes supporting said headed portions of said fasteners, pressing said burst portions inwardly to engage the threaded portions of said fasteners and pressing a reinforcing flange in said sheet metal around the periphery of said opening.

Figure 1:
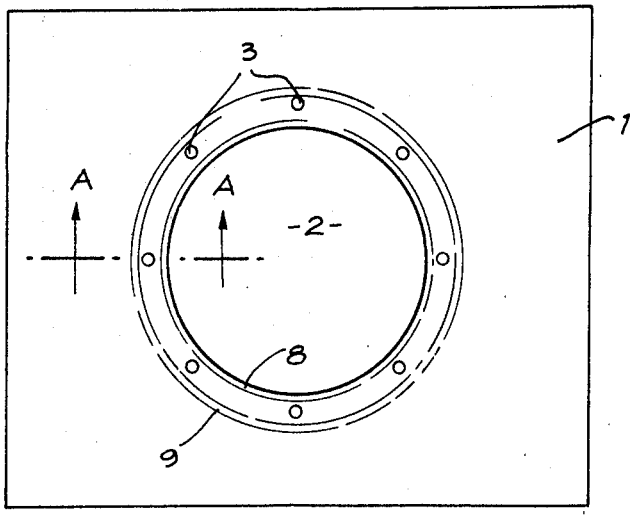
Figure 2:
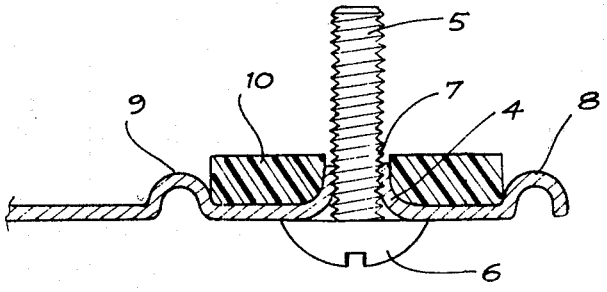

Notwithstanding any other forms that may fall within its scope, one preferred form of the invention will now be described with reference to the accompanying drawings, in which:

FIG. 1 is a diagrammatic plan view of a sheet metal tank top showing a mounting for an inspection cover according to the invention; and FIG. 2 is a sectional view along the line A—A of FIG. 1.

In the preferred form of the invention a mounting for an inspection cover in the top of a sheet metal tank is constructed as follows:

The tak has a sheet metal top 1 in which is formed a circular inspection opening 2. A plurality of holes such as those shown at 3 are burst in the sheet metal top around the periphery of the opening and preferably on a pitch circle centered on the centre of the circular opening 2. The edges of the holes are burst upwardly to form burst portions 4 as may be seen in FIG. 2.

Headed threaded fasteners such as machine screws 5 are then inserted into each hole so that the head 6 of the machine screw is on the opposite side of the sheet metal top 1 from the burst portion 4. The sheet metal top is oriented "up-side down" while the screws are inserted so that they are held in place by gravity.

The sheet metal top with the screws inserted is then placed in a press which has an upper die adapted to support the heads 6 of the machine screws and a lower die having apertures arranged to receive the threaded portions 5 of the machine screws. The mouths of the openings in the lower die are arranged so that when the pressing operation is performed the burst portions 4 are forced inwardly to engage with the threaded portion 7 of the machine screw. This pressing operation forms a steam-tight joint between the sheet metal top 1 and each machine screw and firmly holds the machine screw in position.

Simultaneously in the pressing operation a reinforcing flange 8 is pressed in the sheet metal top around the periphery of the opening 2. For large openings a further reinforcing flange 9 may also be pressed spaced outwardly from the pitch circle of the machine screws 5.

A gasket 10 having a ring configuration with apertures therethrough corresponding to the location of the machine screws may then be placed over the machine screws.

Alternatively the gasket 10 may be dispensed with and a bead of mastic type sealant may be placed around the periphery of the opening to seal the cover.

The inspection cover mounting so formed may then be engaged with a suitable cover (not shown) so that the threaded portions of the machine screws 5 which protrude upwardly from the tank top as studs may be passed through suitably aligned holes in the cover and the cover may be secured in place by engaging washers and nuts with the ends of the machine screws.

In this manner a mounting for an inspection cover is provided which is cheap in that it uses very little extra material and most importantly in that it may be very simply and quickly formed to achieve considerable cost savings.

What we claim is:

1. A method of forming a mounting for an inspection cover or the like in a sheet metal tank, said method comprising the steps of forming the desired opening in the sheet metal wall of said tank, bursting a plurality of holes through said sheet metal around the periphery of said opening, inserting headed, threaded fasteners into said holes so that the headed portions thereof lie on the opposite side of said sheet metal from the burst portions of said holes supporting said headed portions of said fasteners, pressing said burst portions inwardly to engage the threaded portions of said fasteners and pressing a reinforcing flange in said sheet metal around the periphery of said openings.

2. A method as claimed in claim 1 wherein said headed, threaded fasteners, comprise machine screws threaded over the entire length of the shank thereof.

3. A method as claimed in either claim 1 or claim 2 wherein said steps of supporting said headed portions of said fasteners pressing said burst portions inwardly to engage the threaded portions of said fasteners and forming said reinforcing flange, are performed simultaneously in a single pressing operation.

4. A method as claimed in claim 1 wherein a second continuous flange is formed in said sheet metal on the remote side of said fasteners from said opening, said second flange being substantially parallel to said reinforcing flange.

5. A method as claimed in claim 1 including the step of placing a gasket around the periphery of said opening, said gasket incorporating a plurality of holes which align with said headed, threaded fasteners.

* * * * *